United States Patent [19]

Garzon

[11] 4,414,445

[45] Nov. 8, 1983

[54] LIQUID $SF_6$ INTERRUPTER WITH PROPORTIONAL FEEDBACK

[75] Inventor: Ruben D. Garzon, Malvern, Pa.

[73] Assignee: Brown Boveri Electric, Inc., Rolling Meadows, Ill.

[21] Appl. No.: 292,251

[22] Filed: Aug. 12, 1981

[51] Int. Cl.[3] ..... H01H 33/88

[52] U.S. Cl. ..... 200/148 A; 200/150 G

[58] Field of Search ..... 200/148 A, 150 G

[56] References Cited

U.S. PATENT DOCUMENTS 4,219,711 8/1980 McConnell ..... 200/148 A

*Primary Examiner*—Robert S. Macon

*Attorney, Agent, or Firm*—Ostrolenk, Faber, Gerb & Soffen

[57] ABSTRACT

A liquid $SF_6$ interrupter is disclosed comprising a housing containing a pair of pistons operable for movement in tandem. Stationary and movable contact assemblies are disposed between the pistons. At the beginning of the opening stroke of the interrupter, the pistons are caused to begin moving in the same direction as the movable contact. The pistons and housing are so shaped and dimensioned that the movement of the pistons produces a high pressure and a low pressure region located respectively relatively near the stationary and the movable contacts. This causes $SF_6$ to flow across the area between the contacts. An arc between the contacts heats the liquid adjacent it, increasing the liquid pressure. The pistons are so dimensioned that the pressure rise accelerates them, which in turn further increases the pressure differential and the flow of $SF_6$ across the arc region. A small clearance is left between the pistons and the housing, so that no sliding seals are required. Leakage through the clearances is small enough not to hinder the operation of the interrupter. At the downstream end of the travel of each piston is a wide-bore area in which the housing-piston clearance is relatively great, allowing quick equalization of the pressure on the two sides of each piston at the end of the opening stroke.

14 Claims, 2 Drawing Figures

LIQUID $SF_6$ INTERRUPTER WITH PROPORTIONAL FEEDBACK

BACKGROUND OF THE INVENTION

The present invention pertains generally to interrupters in which a dielectric material in the liquid phase is used to quench an arc occurring during interruption, and pertains more specifically to interrupters of this type in which at least some of the power for the opening stroke of the interrupter is supplied by the arc itself.

It is well known that the use of sulfur hexafluoride ($SF_6$) in circuit interrupters permits an interrupter of a given rating to be made considerably smaller than would otherwise be possible. The need for more efficient interrupters, capable of interrupting fault currents in excess of 40 kA and of recovering against the very steep rates of recovery voltages which are associated with the interruption of such currents, has made it desirable to be able to operate an $SF_6$ interrupter at higher pressures than have hitherto been used. Because of the relatively low critical point of $SF_6$, however, it has been necessary to limit the maximum operating pressure to a relatively low value, so that no liquefaction of the dielectric would occur even at the minimum operating temperature. To avoid this limitation, external heating elements have sometimes been used, but this expedient substantially increases the energy consumption of the circuit breaker accessories.

Interrupters in which the operating pressure is such as to maintain the $SF_6$ in the liquid phase at all times, regardless of the ambient temperature, have also been devised. In one such interrupter, the dielectric liquid is caused to flow through the arcing region during interruption. This is done by providing two pistons rigidly connected to each other, with the contact assemblies located between them. A chamber communicating via an orifice with the arc region is provided in the interrupter between the stationary contact assembly and the adjacent piston. During interruption, the piston adjacent the stationary contact assembly moves toward the orifice, compressing the fluid in the chamber and forcing it through the orifice. At the same time, the other piston is moving away from the orifice and the contact assemblies, increasing the volume downstream of the orifice and thus producing a region of relatively low pressure. The resulting pressure differential causes the dielectric liquid to flow through the orifice and past the contact assemblies, quenching the arc as it does so. The orifice is designed to act as a nozzle, accelerating the liquid and increasing its quenching action. An interrupter of this type is disclosed in U.S. Pat. No. 4,268,733, issued May 19, 1981, to the present inventor for A LIQUID $SF_6$ PUFFER TYPE CIRCUIT INTERRUPTER.

Since interrupting capability is primarily a function of the pressure differential across the nozzle, it will be understood that interruption of a high current requires a high pressure differential. However, the force required to develop a very high pressure differential in a quasi-incompressible fluid such as $SF_6$ is very great, and this together with the length of time it must be sustained to ensure successful interruption of a current as large as 40 kA exceeds what can be achieved with operating mechanisms in use at the present time.

To avoid using excessively large and massive operating mechanisms, it is possible to utilize the energy liberated by the arc itself to power the interrupter. This energy can be used by making the effective area of the upstream and downstream pistons different, so that an increase in the fluid pressure in the region between them will exert a net accelerating force on the piston assembly in one direction (toward the piston having the larger effective area). An interrupter employing such a differential piston assembly is disclosed in U.S. Pat. No. 4,278,860, issued to Jiing-Liang Wu on July 14, 1981, for an ARC DRIVEN SINGLE PRESSURE TYPE CIRCUIT BREAKER.

The energy liberated by the arc is equal to the integral, taken over the total lifetime of the arc, of the product of the arc voltage and the arc current. It can be shown that this available arc energy is much greater than the energy available from any commercially available operating mechanism. Moreover, the arc energy, which is available free of charge, can be utilized to displace the pistons and create the pressure differential necessary to produce the dielectric liquid flow, by making use of the increase in enthalpy of the liquid $SF_6$ that occurs as it absorbs energy from the arc. The increase in enthalpy results in an increase in pressure proportional to the current being interrupted. By making use of the arc energy and a suitably chosen difference between the two pistons' effective area, it is possible to produce quite large pressure differentials.

The use of a piston assembly comprising tandem-operated pistons having different effective areas, however, implies that at the end of the travel of the piston assembly the net volume occupied by the liquid $SF_6$ in the space between the pistons is greater than at the beginning of the opening stroke, so that the final pressure in the interrupter is lower than before interruption. To repressurize the interrupter, it is necessary to do work on the liquid during the closing of the interrupter. One solution to this problem, disclosed in U.S. Pat. No. 4,278,860, is to store some of the energy produced by the arc. Either mechanical or pneumatic springs can be used for this purpose. The springs are compressed or charged while the pressure increases, and when the interruption has been completed and the pressure in the interrupter begins to fall, the springs supply the force necessary to return the piston assembly to the original equilibrium position. Although this approach is viable, it is somewhat cumbersome mechanically. In addition, interrupters of this type present certain manufacturing problems in that they require relatively large high pressure sliding seals between the pistons and the interrupter housing, and extremely fine finishes on the cylindrical walls of the pistons are required for acceptable sliding seal performance.

SUMMARY OF THE INVENTION

It is the principal object of the present invention to provide a circuit interrupter which employs a dielectric liquid as a quenching medium and which is free of the above disadvantages of the prior art.

It is another object of the invention to provide an interrupter that can be automatically reset without the use of mechanical or pneumatic springs.

It is still another object of the invention to provide an interrupter of the above-described type having improved interrupting action.

It is still another object of the invention to provide an interrupter of the above-described type in which the pistons need not have the extremely fine finish required in prior art interrupters of this type.

It is yet another object of the invention to provide an interrupter of the above-described type in which the dielectric fluid acts on the piston assembly to provide a net biasing force that biases the interrupter into the closed position.

According to the present invention, a liquid $SF_6$ interrupter has a piston assembly comprising two pistons rigidly connected to each other and disposed to either axial side of the arc region. The piston assembly is adapted to force the liquid dielectric to flow through the arc region, the pistons being so shaped that once they have been set in motion at the beginning of the opening stroke of the interrupter, they are further accelerated by heat from the arc itself, and the relative areas of the respective faces of the pistons are such as to provide a net force biasing the pistons toward a reset position, which is the position they occupy when the contacts are in their engaged position and the interrupter is ready to operate for interruption. While in early liquid dielectric interrupters the back face of each piston (i.e. the upstream face of the upstream piston and the downstream face of the downstream piston) was exposed to atmospheric pressure, in the interrupter of the invention the same pressure is applied to all faces of both pistons when the interrupter is in an equilibrium condition. The dielectric liquid is at a uniform pressure throughout the interrupter housing. This is done by eliminating the sliding piston seals used in prior art interrupters, leaving a reasonably small clearance between each piston and the housing wall that defines the cylinder in which it moves. A small leakage flow is thus allowed across each piston, so that if any pressure differential should exist across the piston the pressure will tend to equalize itself in time. During interruption, however, very great pressure differentials are created in extremely short times, and the flow around the pistons is too small to equalize the pressure quickly, and the pressure differentials are thus able to apply a net force to the pistons to accelerate them in a manner described below, as well as to cause the dielectric to flow across the arc region. At the downstream end of the travel of each piston the diameter of the housing increases. When the pistons reach the wide-bore regions, flow around the piston edges increases so that pressure equalization within the interrupter is quickly completed. The rush of the dielectric liquid around the piston edges has been found to cause the piston assembly to travel a short distance upstream, i.e. toward the reset position it occupies at the beginning of the interruption process. As explained below, the pistons are designed in such a manner that when the pressure in the interrupter is uniform, the liquid dielectric will exert a net force on the piston assembly that tends to return it to its reset position. After interruption is complete, this biasing force serves to reset the interrupter without the use of mechanical or pneumatic springs.

Other objects and features of the invention will become apparent from the following description and the accompanying drawings.

DETAILED DESCRIPTION OF THE PREFERRED EMBODIMENT

Figure 1:
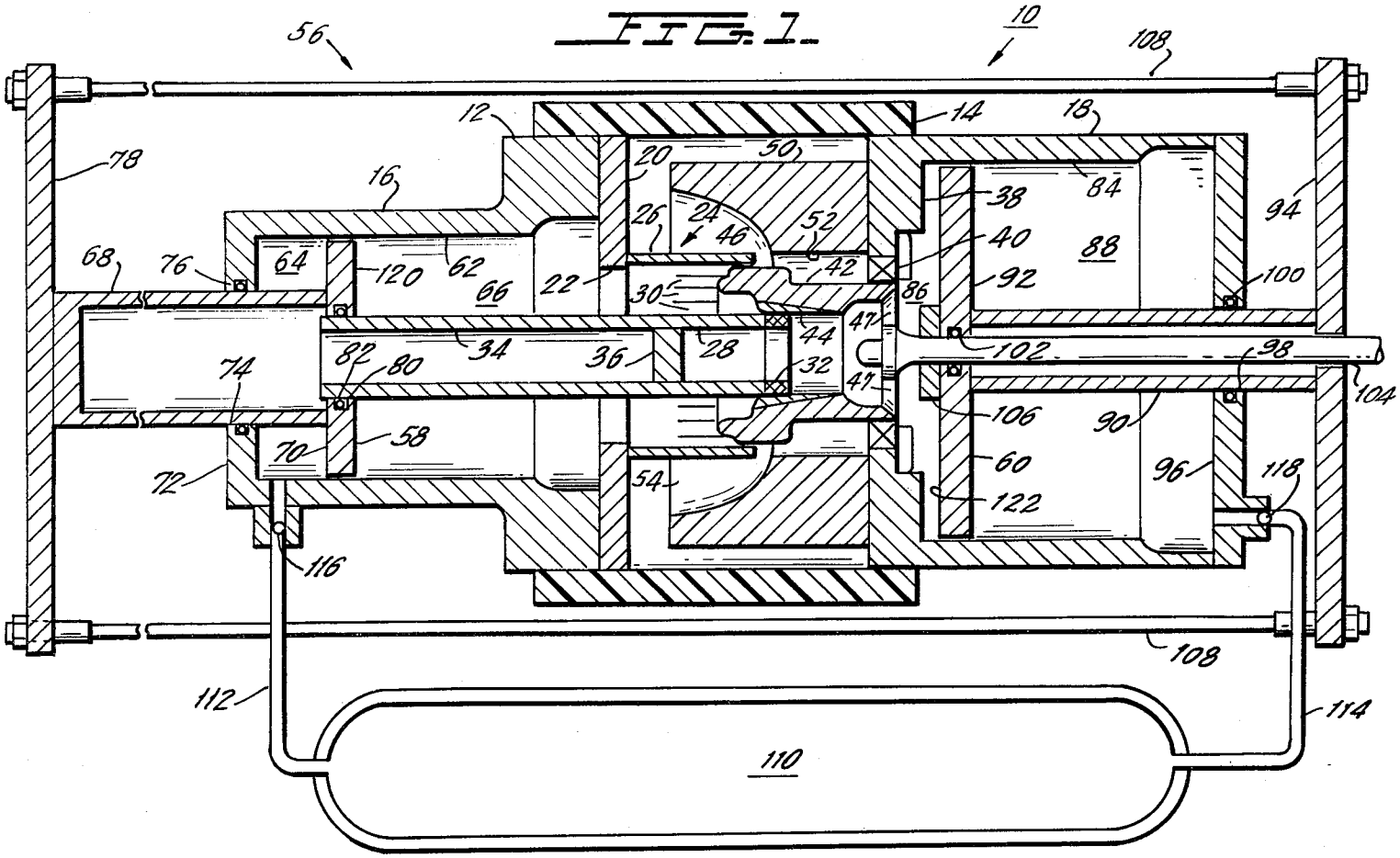
FIG. 1 is a cross-sectional view of one preferred embodiment of the interrupter of the invention, showing the contacts in the closed position and the piston assembly in its reset position.

FIG. 1 shows a preferred embodiment of the interrupter 10 of the present invention in the closed position. The interrupter 10 has a three part conductive housing 12 filled with a dielectric liquid, preferably liquid $SF_6$, and comprising a central insulative portion 14 and conductive end portions 16 and 18. The central portion 14 has the form of a cylinder in which end portions 16 and 18 are received.

An annular conductive adapter plate 20 is disposed in the interrupter housing 12 at the downstream end (right-hand end in the Figures) of the left-hand housing portion 16. The adapter plate 20 is disposed perpendicular to the axis of the interrupter 10 and is provided with a central bore 22 or orifice. The stationary contact assembly 24 is mounted in housing 12 by means of adapter plate 20 and comprises a main stationary contact 26 and a stationary arcing contact 28. The main stationary contact 26 comprises a cylindrical array of conductive contact fingers 30 secured to the adapter plate 20 about the circumference of the orifice 22. An inner stationary contact or arcing contact 28, having the form of a conductive cylinder, is disposed in the orifice 22 of the adapter plate 20 coaxially therewith. A plurality of conductive spokes (not shown in the Figures) disposed in the orifice 22 support the inner stationary contact 28 fixedly in position. The downstream end 32 of the inner stationary contact 28 is made of a conventional arc resistant material. This end 32 of the arcing contact 28 extends farther downstream (to the right) in the interrupter housing 12 than the contact fingers 30 of the main stationary contact 24. The other end 34 of the stationary arcing contact 28 extends far into the interior of the left-hand housing portion 16. A plug 36 is provided in the interior of stationary arcing contact 28 for a reason explained below.

Figure 2:
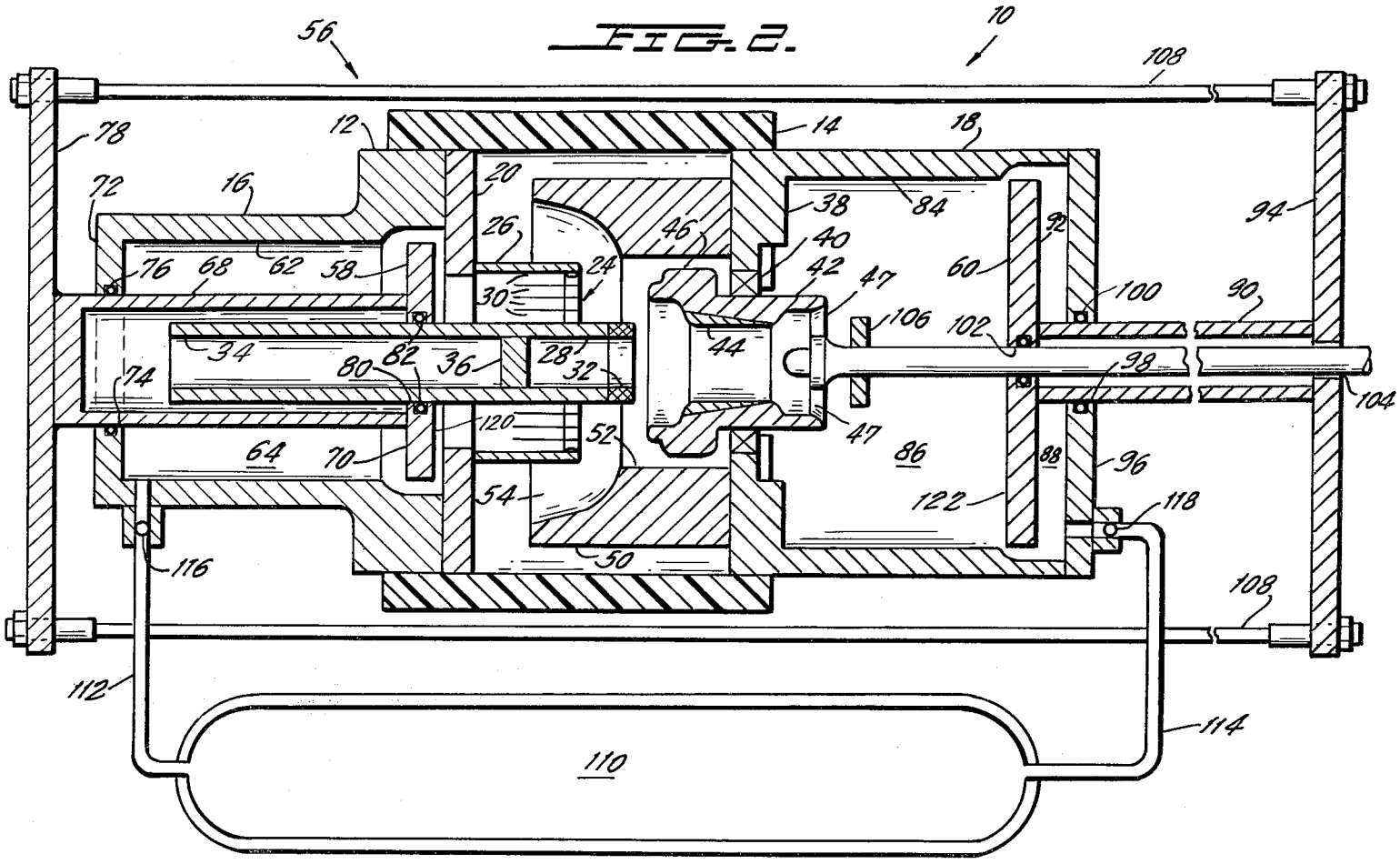
FIG. 2 is a view like that of FIG. 1, showing the contacts in the fully open position and the piston assembly in the position it has at the comletion of interruption and before the contacts are reclosed.

The upstream end (left-hand end in the Figures) of the right-hand housing portion 18 is provided with an annular conductive flange 38 whose radially interior surface is covered by an annular distribution of contact transfer material 40. The annulus of contact transfer material 40 serves as a collar in which a generally cylindrical movable contact 42 is slidably received. The movable contact 42 is provided with an axial bore 44 extending the full length of contact 42 and lined with arc-resistant material which in the closed position of the interrupter 10, shown in FIG. 1, engages the arc-resistant material of the stationary arcing contact 28. The outer surface of the movable contact 42 comprises a conductive collar or flange 40 which in the interrupter's closed position is received within the interior of the cylinder defined by the stationary contact fingers 30. The resilience of the latter ensures good electrical contact between them and the collar or flange 46 of the movable contact 42. The downstream (right-hand) end of the movable contact 42 is affixed by spokes 47 to one end of an insulative operating rod 48, which extends to the exterior of the interrupter 10 and which is powered and operated in a well known fashion by means of conventional equipment (not shown) to open or close the interrupter 10. An additional conductive collar 50 is affixed to the upstream (left-hand) surface of the annular flange 38 of the right-hand housing portion 18. The collar 50 has a central bore 52 coaxial with the contact assemblies 24, 42, and at its upstream end 54 the bore 52 is flared outward. The main stationary contact 26 extends most of the way into the flared portion 54 of the bore 52, and the stationary arcing contact 28 extends somewhat into the straight portion of the bore 52. The moving contact 42, in the open position of the interrupter 10 shown in FIG. 2, extends partially into the straight portion of the bore 52 of the collar 50, and in the closed position of the interrupter 10 extends through the straight portion and into the flared portion of the bore 52. A function of the collar 50 with its flared bore 52 is to ensure that during interruption, the liquid dielectric flows through the space between the main stationary contact 26 and the stationary arcing contact 28 and into the bore 44 of the moving contact 42, so as to quench the arc.

During interruption the dielectric liquid is caused to flow across the arc region by means of a piston assembly 56 comprising an upstream piston 58 and a downstream piston 60. The left-hand portion 16 of housing 12 has a bore 62 of a first diameter, in which the upstream piston 58 is slidably received. Piston 58 divides the interior of portion 16 of the housing 12 into upstream and downstream chambers 64 and 66. A first tubular conductive connecting piece 68 has one end rigidly connected, as by welding, to the upstream or back surface 70 of piston 58. The end wall 72 of housing portion 16 is provided with a central bore 74 in which connecting piece 68 is slidably received. The interface between connecting piece 68 and bore 74 is provided with a seal 76. The end of connecting piece 58 remote from piston 58 is secured to a piston assembly end plate 78. Piston 58 has a bore 80 formed therein, in which the tubular inner stationary contact 28 is slidably received. A seal 82 is provided in bore 80. The inner stationary contact 28 extends most of the way from the axially middle portion of the interrupter 10 to the upstream end thereof, and the connecting piece 68 is sufficiently long to allow piston 58 to slide along most of the portion of the length of the inner stationary contact 28 that extends upstream of the adapter plate 20.

The right-hand housing portion 18 has a bore 84 whose diameter is considerably larger than that of bore 74 of the left-hand housing portion 16. The downstream piston 60 is slidably received in bore 84. There is no sliding seal between the piston 60 and bore 84, a slight clearance being left between them. The piston 60 divides the interior of right-hand housing portion 18 into upstream and downstream chambers 86, 88. One end of a second tubular connecting piece 90 is fixedly attached, as by welding, to the back or downstream surface 92 of the piston 60, and has its other end permanently affixed to a second piston assembly end plate 94. The downstream end of right-hand housing portion 18 is closed by a movable end plate 96, which is provided with a bore 98 in which the connecting piece 90 is slidably received. The interface between the bore and the connecting piece 98 is sealed by means of a seal 100. The downstream piston 60 and piston assembly end plate 94 are provided with respective central bores 102, 104 in which the operating rod 48 is slidably received. The upstream limit of travel of the downstream piston 60 is defined by a flange 106 secured to the operating rod 48 near the point where the latter is securd to the movable contact 42.

The piston assembly end plates 78, 94 are rigidly secured to each other by a plurality of insulative connecting rods 108 of identical length, so that the two pistons 58, 60 move in tandem at all times. The left-hand or upstream limit of travel of the piston assembly 56 is established by the flange 106 on the operating rod 48, while the downstream limit of travel is established by the adapter plate 20 or the downstream end plate 96 of the interrupter 10, or both.

A manifold 110 containing the liquid dielectric at a standard pressure Po is connected by lines 112, 114 to chambers 64 and 88. The first line 112 is provided with a check valve 116 to permit dielectric liquid to flow from the manifold 110 to chamber 64 when pressure in the latter falls below Po but to prevent flow in the opposite direction. A similar check valve 118 in the other line 114 permits flow of the liquid from camber 88 to the manifold 110 when a pressure differential of the proper sign occurs between them.

When the interrupter 10 is in equilibrium, i.e. when the dielectric liquid pressure is uniform throughout the interrupter 10, the same pressure is applied to both surfaces of both pistons 58, 60. Because of the presence of the connecting pieces 68, 90, each of the pistons 58, 60 has a smaller total effective area on its back surface 70, 92 than on its front surface 120, 122. As a result, the dielectric liquid in housing 12 exerts a net axial force on each piston 58, 60, downstream (to the right) in the case of the downstream piston 60 and upstream (to the left) in the case of the upstream piston 58. The magnitude of each of these net forces is equal to the liquid pressure times the difference in total effective area between the front and back surfaces of the respective piston. According to the invention, the cross-sectional area of the connecting piece 90 of the downstream piston 60 is smaller than that of the connecting piece 68 of the upstream piston 58. The magnitude of the net upstream force on the upstream piston 58 is therefore greater than that of the net downstream force on the downstream piston 60. Thus when the interrupter 10 is in equilibrium, there is a net force on the piston assembly 56 tending to urge it to the position shown in FIG. 1.

The operation of the novel interrupter 10 of the invention will now be described.

At the beginning of an interruption, the interrupter 10 is in the position shown in FIG. 1. In this position, the piston assembly 56 is at the upstream (left-hand) limit of its travel, with the large diameter (downstream) piston 60 resting against the flange 106 on the operating rod 48. To initiate the process the movable contact 42 is retracted by means of the operating rod 48 from the engaged position shown in FIG. 1 to the disengaged or open position shown in FIG. 2. As the movable contact 42 is withdrawn, its annular collar 46 disengages from the ring of contact fingers 30 making up the main stationary contact 26. Shortly thereafter the inner layer of arc-resistant material lining the bore 44 of the movable contact disengages from the stationary arcing contact 28, giving rise to an arc therebetween. The arc is quenched by the flow of liquid dielectric across it, impelled by the piston assembly 56 in a manner now to be described.

When the interrupter 10 is opened, the movement of the movable contact 42 places the piston assembly 56 in motion by means of the flange 106. This is necessary to begin the movement of the pistons 58, 60, but their further movement is powered by energy derived from the arc itself. As the piston assembly 56 is moved by the flange 106, the dielectric liquid immediately downstream of the upstream piston 58 is compressed, while that immediately upstream of the downstream piston 106 is correspondingly decompressed. This gives rise to a pressure differential across the arc region, which in turn causes a flow of the dielectric liquid from the chamber 66, through the space between the inner and outer stationary contacts 28, 26, through the arc, and through the bore 44 of the movable contact 42 into the chamber 86. The passage of this fluid begins to quench the arc.

The arc generates a considerable amount of heat at a rate equal to the product of the current being interrupted and the voltage drop between the arcing contact 28 and the movable contact 42. Part of this energy is absorbed by the dielectric liquid immediately surrounding the arc. Since in the preferred embodiment the dielectric liquid is $SF_6$, which is quasi-incompressible, the heat absorbed by the liquid raises the enthalpy thereof, causing a rise in the liquid pressure in the arc region. Because the effective area of the front face 122 of the downstream piston 60 is greater than that of the front face 120 of the upstream piston 58, the rise in pressure causes a net force on the piston assembly 56, accelerating it downstream (to the right). The acceleration of the piston assembly 56 in turn increases the pressure differential between the region immediately downstream of the front face 120 of the small diameter upstream piston 58 and the region immediately upstream of the front face 122 of the large diameter downstream piston 60, increasing the rate of flow of the dielectric liquid through the arc. The flow of liquid through the arc region is continuously increased in this manner until the arc is quenched.

Once the arc has been extinguished, the rise in pressure ceases. The pressure in the interrupter 10 is now able to equalize as a result of the flow of the liquid around the edges of the pistons 58, 60. This pressure equalizing flow increases greatly once the pistons 58, 60 reach the wide bore portions of their paths. The quick movement of fluid around the piston edges when this occurs has the effect of pushing the piston assembly 56 a short distance in the upstream direction, thus effecting a partial reset of the mechanism. A complete reset cannot be achieved in this manner, however, both because of the limited upstream impetus given the piston assembly 56 by this phenomenon and because the presence of the movable contact 42 in its disengaged position prevents the complete return of the piston assembly 56 to the reset position shown in FIG. 1.

As stated above, when the pressure in the interrupter 10 is substantially uniform, the difference in size between the large downstream and small upstream pistons 60, 58 and the difference in cross-sectional area between the respective connecting pieces of the two pistons causes the dielectric liquid to exert a net force on the piston assembly 56 in the upstream direction. Once the pistons 58, 60 reach the wide bore portion of their travel during interruption, the transient non-uniformities in the liquid pressure are eliminated very quickly. As a result, when the interrupter 10 is reclosed by means of the operating rod 48, the piston assembly 56 is urged to the reset position shown in FIG. 1 by the dielectric liquid. In this manner the piston assembly 56 of the interrupter 10 is able to reset itself automatically when the interrupter 10 is reclosed, without the use of either mechanical or pneumatic springs.

The interrupter 10 of the invention as shown can be enclosed in a grounded conductive housing filled with $SF_6$ in the gaseous phase, or can be used in the air without any additional protection.

The interrupter 10 is connected electrically to other components by means of conventional terminals (not shown) that are electrically connected to the conductive end portions 16, 18 of the interrupter housing 12. When the interrupter 10 is in the closed position, current passes through the downstream end plate 96, through the wall of the right-hand housing portion 16, through the annular flange 38 of the latter, the contact transfer material 40, the movable contact 42, the main and inner stationary contacts 26, 28, the adapter plate 20, and the walls and end panel 72 of the left-hand housing portion 18.

The present invention may be embodied in other specific forms without departing from the spirit or essential attributes thereof and, accordingly, reference should be made to the appended claims, rather than to the foregoing specification as indicating the scope of the invention.

What is claimed is:

1. A circuit interrupter, comprising;

a housing containing a dielectric material in the liquid phase;

stationary contact means disposed in said housing;

movable contact means disposed in said housing and movable between an engaged position in which it is in electrical contact with said stationary contact means and a disengaged position in which it is mechanically remote from and electrically isolated from said stationary contact means; and a piston assembly movable between a first position and a second position, said piston assembly being for increasing pressure in a first region of said housing and for simultaneously decreasing pressure in a second region of said housing while moving from said first to said second position, thereby to create a pressure differential between said first and second regions, for causing said dielectric material to flow from said first to said second region as said piston assembly moves from said first to said second position; said piston assembly being adapted to be accelerated in a direction from said first toward said second position by energy generated by an arc between said stationary and said movable contact means; and said piston assembly being subject to a force exerted on it by said dielectric material urging said piston assembly in a direction from said second toward said first position, when the pressure of said dielectric material is substantially uniform throughout said housing; said piston assembly being movable independently of the movement of said movable contact means.

2. The interrupter of claim 1, wherein said piston assembly comprises first and second pistons disposed in said housing, said contact means being disposed between said pistons.

3. The interrupter of claim 2, wherein said first piston is relatively far from said contact means and said second piston is relatively close to said contact means when said piston assembly is in said first position, and wherein said first piston is relatively near and said second piston is relatively far from said contact means when said piston assembly is in said second position.

4. The interrupter of claim 2, wherein said piston assembly further comprises a plurality of insulative connecting rods rigidly connecting said first and second pistons to maintain them at a predetermined distance from each other, whereby said first and second pistons are adapted to move in tandem.

5. The interrupter of claim 2, wherein said movable contact means comprises a movable contact that is movable between said engaged and said disengaged positions, and an operating rod for moving said movable contact between said engaged and disengaged positions.

6. The interrupter of claim 5, further comprising means for causing said piston assembly to begin to move from said first position toward said second position when said movable contact means begins to move from said engaged position to said disengaged position.

7. The interrupter of claim 6, wherein said means for initiating the movement of said piston assembly comprises flange means disposed on said operating rod for engaging said second piston to initiate movement of said piston assembly when said movable contact is moved from said engaged to said disengaged position, said flange means engaging said second piston when said movable contact is in said engaged position and said piston assembly is in said first position.

8. The interrupter of claim 2, wherein said first region of the interior of said housing is a portion of the interior thereof defined between said first piston and said stationary contact means, and wherein said second region is a portion of the interior of said housing lying between said movable contact means and said second piston.

9. The interrupter of claim 8, wherein said housing has first and second portions in which said first and second pistons are respectively slidably received, a first clearance being left between each said piston and the corresponding said housing portion in which it is received.

10. The interrupter of claim 9, wherein said housing further comprises third and fourth portions contiguous with said first and second portions respectively, said first and second pistons being slidable into said third and fourth portions of said housing respectively, and the internal diameter of said third and fourth portions being greater than those of said first and second portions respectively.

11. The interrupter of claim 2, further comprising a high pressure manifold containing said dielectric material in the liquid phase, said manifold communicating with the interior of said housing for maintaining the equilibrium pressure of said dielectric liquid in said housing at a predetermined value.

12. The interrupter of claim 11, wherein said housing has first and second end panels, said first piston and said first end panel defining a first end chamber between them and said second piston and said second end panel defining a second end chamber between them; the interior of said manifold communicating with said first and second end chambers via first and second check valves respectively for admitting dielectric from said manifold to said first end chamber when the pressure in said first end chamber falls below that in said manifold, and for relieving the pressure in said second end chamber when the pressure therein exceeds that in said manifold.

13. The interrupter of claim 1, wherein said dielectric material is sulphur hexafluoride.

14. The interrupter of claim 1, wherein said stationary contact means comprises coaxial inner and outer stationary contacts defining an annular orifice between them, said stationary contacts being disposed between said first region and said movable contact means.

* * * * *